US005348082A

United States Patent [19]

Velluet et al.

[11] Patent Number: 5,348,082

[45] Date of Patent: Sep. 20, 1994

[54] HEAT EXCHANGER WITH TUBES OF OBLONG CROSS SECTION, IN PARTICULAR FOR MOTOR VEHICLES

[75] Inventors: Pascal Velluet, Cernay la Ville; Jacques Hoffnung, Ile Saint Denis, both of France

[73] Assignee: Valeo Thermique Moteur, Saint-Oden Cedex, France

[21] Appl. No.: 51,485

[22] Filed: Apr. 22, 1993

[30] Foreign Application Priority Data

Apr. 24, 1992 [FR] France ..... 92 05111

[51] Int. Cl.[5] ..... F28F 9/02

[52] U.S. Cl. ..... 165/173; 165/178

[58] Field of Search ..... 165/173, 178

[56] References Cited

U.S. PATENT DOCUMENTS

| | | | |
|---|---|---|---|
| 2,009,863 | 7/1935 | Trane | 257/139 |
| 4,467,511 | 8/1984 | Collgon | 29/157.3 |
| 4,485,867 | 12/1984 | Melnyk et al. | 165/173 |
| 4,682,650 | 7/1987 | Potier | 165/173 |
| 5,101,561 | 4/1992 | Fuhrmann et al. | 29/890.043 |

FOREIGN PATENT DOCUMENTS

| | | | |
|---|---|---|---|
| 2009122 | 9/1970 | Fed. Rep. of Germany | F28F 9/14 |
| 8323074 | 12/1988 | Fed. Rep. of Germany | F28F 9/16 |
| 2031668 | 11/1970 | France | B21D 53/00 |
| 1388690 | 4/1988 | U.S.S.R. | 165/173 |
| 1306255 | 2/1973 | United Kingdom | F16L 13/08 |
| 2105835 | 3/1983 | United Kingdom | 165/173 |

*Primary Examiner*—Allen J. Flanigan
*Attorney, Agent, or Firm*—Richard K. Warther

[57] ABSTRACT

A heat exchanger, especially a cooling radiator for motor vehicle engine, comprises a multiplicity of tubes of oblong cross section, each having an end portion fitted in a corresponding hole formed in a header plate, the joint being sealed by means of a sealing gasket. The sealing gasket has a tubular portion compressed between each tube end portion and an internal surface of the corresponding hole in the header plate, each tube end portion being formed with a peripheral bead spaces away from the terminal edge of the tube.

10 Claims, 1 Drawing Sheet

HEAT EXCHANGER WITH TUBES OF OBLONG CROSS SECTION, IN PARTICULAR FOR MOTOR VEHICLES

FIELD OF THE INVENTION

This invention relates to a heat exchanger of the type comprising a multiplicity of tubes of oblong cross section, each of which has an end portion engaged in a corresponding hole which is formed in a header plate, with a sealing gasket being interposed, a portion of the sealing gasket associated with each respective tube end portion being compressed between the latter and a surface of the corresponding hole in the header plate.

Such heat exchangers are used, especially, as radiators for cooling motor vehicle engines.

BACKGROUND OF THE INVENTION

The oblong cross section of the tubes may depart to a greater or lesser extent from the shape of a circle, and it may for example, be oval, elliptical or flattened in shape. In this last case it may have two long sides opposed to each other, and two opposed short sides. The long sides may be straight or curved and the short sides are curved. Such tubes of oblong cross section are so disposed that the largest dimension of their cross section extends in the direction which is substantially parallel to the direction of flow of air through the bundle of tubes in the heat exchanger. In this way, heat exchangers are made which have both an improved efficiency and a reduced size as compared with heat exchangers in which the tubes are of circular cross section.

In heat exchangers of the type described above, which may also be called "mechanical assembly heat exchangers", the quality of the seal at the level of the joint between the end portion of each tube and the header plate depends mainly on the mechanical strength of the tube end portion when subjected to the mechanical force exerted on it by the surrounding portion of the sealing gasket. The resistance of the tube end portion to this applied force depends mainly on its rigidity, and especially on the shape of its cross section. In this connection, the closer the cross sectional shape of the end portion is to a circle, the greater will be its rigidity. Conversely, the more the shape of the cross section departs from a circular shape, i.e. the more flattened it is, the less rigid will be the end portion of the tube. This reduction in rigidity occurs in the regions of the cross section which lie in the direction of the largest dimension, that is to say along its long sides. This represents a drawback which is all the more serious in view of the current trend towards the use of tubes having an oblong cross section with a very flattened configuration.

In order to overcome this disadvantage, various solutions have already been proposed for increasing the strength of the end portions of tubes having oblong cross sections. For example, one such solution is described in the specification of French published patent application FR 2406794A, which proposes, in particular, that the long sides of the oblong cross section should be thickened as compared with the short sides. This makes it necessary to extrude special tubes of non-constant thickness. The same French patent specification also proposes to introduce particular special profile shapes into the end portions of the tube, such as to prevent deformation of the end portions. Such a solution is not satisfactory because it necessitates an additional fitting operation, and it is also detrimental to the flow of fluid through the tubes.

In addition, it has been proposed, for example in the specification of French published patent application FR 2570814A, to form a peripheral bead on the end portion of a tube of circular cross section, so as to serve as an abutment during introduction of this end portion into a corresponding hole in a header plate. In this way a predetermined spacing is provided between two header plates, and therefore between two headers of a heat exchanger.

DISCUSSION OF THE INVENTION

A principal object of the invention is to provide a heat exchanger of the type described above, in which the end portions of the tubes are reinforced in a particularly simple way without making it necessary to perform any complicated fitting operations, and without disturbing the flow of the fluid through the tubes of the heat exchanger.

Another object of the invention is to propose such a heat exchanger in which the end portions of the tubes, the latter being of oblong cross section, are reinforced in a particularly effective manner regardless of the particular shape of the oblong cross section, and especially when the latter is very elongated and flattened.

According to the invention, a heat exchanger comprising a multiplicity of tubes of oblong cross section, which include end portions engaged in corresponding holes formed in a header plate, with a sealing gasket being interposed, the sealing gasket having tubular portions, each of which is compressed between a respective said tube end portion and a surface of the corresponding hole, is characterised in that each tube end portion has a tube wall reinforced by a bead spaced away from a free terminal edge of the end portion.

The peripheral bead enables the wall of the tube end portion to be made very rigid, and thus prevents it from being deformed under the effect of the mechanical forces applied by the surrounding tubular portion of the sealing gasket.

It should be noted that the peripheral bead, which is provided on each tube in accordance with the present invention, is formed on a tube end portion of oblong cross section, and not on one having a circular cross section as in the prior art mentioned above. It should also be noted that it performs a different, and novel, function from that in the prior art, namely a reinforcing function which is not present in the case of tubes having end portions of circular cross section.

In one form of heat exchanger according to the present invention, the said free edge of the end portion of each tube is formed in extension of the oblong cross section of that tube, and the end portion is deformed by radial expansion of its wall so as to compress the said tubular portion of the sealing gasket radially, the latter lying between the end portion of the tube and the internal surface of the corresponding hole in the header plate.

Preferably, in this form of heat exchanger according to the invention, the said internal surface of each hole is delimited by a collar portion depending from the header plate, and the radial expansion of the end portion of each tube takes place over a length which is at least equal to the length of the associated collar portion.

In another form of heat exchanger according to the invention, the free edge of the tube end portion is deformed at least partially so as to form a flared mouth of the tube. This flared mouth may be formed over the whole periphery of the tube, or it may be only local. As a result, each tubular gasket portion which provides the sealing effect lies in the annular space defined between, firstly, the bead and the flared mouth of the associated tube, and secondly the end portion of that tube and the internal surface of the corresponding hole.

In this form of heat exchanger, each tubular gasket portion may undergo either radial compression between the tube end portion and the internal surface of the hole, or axial compression between the tube and the flared mouth of the tube, or again both such radial compression and axial compression at the same time.

Preferably also, in this second form of heat exchanger according to the invention, in which the said internal surface of each hole is delimited by a collar portion depending from the header plate, and each tubular portion of the sealing gasket is in the form of a tube element interposed between the said surface of the corresponding hole and the end portion of the corresponding tube, each said tubular portion of the gasket is compressed in the annular space which is delimited axially by the bead and the flared mouth of the corresponding tube, and radially by the said surface of the corresponding hole and the said tube end portion.

In the various embodiments of the invention mentioned above, each bead preferably extends over the whole periphery of the corresponding tube end portion. However, it may, as in the previous form, extend only over part of its periphery.

In the description of preferred embodiments of the invention which follows, and which is given by way of example only, reference is made to the accompanying drawings.

DESCRIPTION OF PREFERRED EMBODIMENTS OF THE INVENTION

Figure 1:
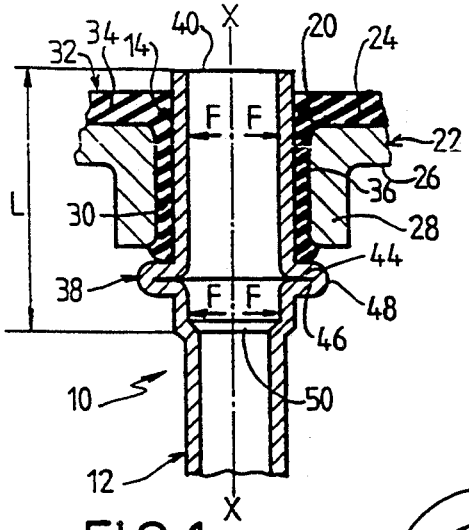
FIG. 1 is a view in cross section showing part of the heat exchanger, illustrating in particular the assembly of an end portion of a heat exchanger tube with a header plate.
Figure 2:
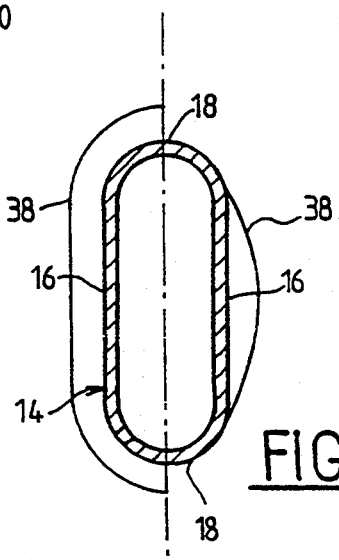
FIG. 2 is an end view showing the oblong shape of the end portion of the tube of FIG. 1.

Reference is first made to FIG. 1, which shows a tube 10 defining an axis X—X forming part of a heat exchanger, and in particular a cooling radiator for a motor vehicle. The tube 10 has a body 12 of oblong cross section, which is extended by an end portion 14 formed initially with the same oblong shape of the body 12 of the tube. As can be seen in FIG. 2, the end portion 14 has, in this example, a cross section of generally oblong shape defined by two long sides 16, which are straight and parallel to each other, together with two short sides 18, each of which is semi-circular.

The heat exchanger comprises a multiplicity of the tubes 10, arranged parallel to each other so as to constitute a bundle of tubes which communicates with two opposed fluid headers (not shown), one at each end of the tubes. The tubes are made of a suitable metallic material, preferably aluminium or an aluminium alloy.

Each of the end portions 14 of the tubes is introduced into a hole 20 formed through a header plate 22, which may also be referred to as a perforated plate or collector plate. Each header plate is a part of a respective one of the two headers of the heat exchanger. Each header plate 22 has a multiplicity of the holes 20, arranged on a pre-determined geometric plan which corresponds to the configuration of the tubes 10, all in the well-known manner. Each of the header plates 22 is in this example made of a metallic material, though they could also be made by moulding in a suitable plastics material.

The header plate 22 is delimited by two opposed faces 24 and 26, and each of the holes 20 is bounded by a tubular collar portion 28 which projects from the face 26 of the plate. This collar portion 28 has an internal surface 30 of oblong cross section, of matching shape to, though larger than, the oblong cross section of the end portion 14 of the corresponding tube. To ensure proper sealing between the header plate 22 and the respective tubular end portions 14 of the tubes 12 in the bundle, a sealing gasket 32 is provided. This is for example of an elastomeric material, and consists mainly of a mat 34 which is applied flat against the face 24 of the header plate 22. This mat 34 has a multiplicity of tubular extensions 36, each of which acts as a seal portion for sealing between the tube end portion 14 and the internal surface 30 facing towards the latter.

To the extent to which it has so far been described, the heat exchanger is of a known kind.

Due to the fact that each of the tubular portions 36 of the gasket is compressed between the surface 30 and the corresponding tube end portion 14, a mechanical reaction force is set up in the gasket, which tends to contract the oblong cross section of the tube end portion 14. This reaction force acts principally on the long sides 16 of the end portion 14, which tend to be urged towards each other. In order to overcome this drawback, the end portion 14 of the tube is reinforced by a peripheral bead 38 lying spaced away from the free terminal edge 40 of the tube. This terminal edge 40 lies beyond the mat portion 34 of the gasket 32, as can be seen in FIG. 1.

The peripheral bead 38 is made by expanding the wall of the tube 10, forming two annular pleats 44 and 46 extending in planes at right angles to the axial direction X—X of the tube 12, the two pleats 44 and 46 being joined by a rounded peripheral edge 48. The bead 38 extends round the whole of the periphery of the end portion 14 and reinforces the latter, especially on the long sides 16, thus preventing it from being deformed under the effect of the mechanical reaction force exerted by the associated tubular portion 36 of the gasket.

As can be seen in the right hand side of FIG. 2, the bead 38 may extend over only part of the periphery of the end portion 14. In particular, it can be arranged that the bead lies only along the long sides 16. It may then have, as shown, a transverse dimension which, on each side 16, increases from a point adjacent to one of the short sides 18 up to a maximum in the middle of the long side 16, then decreasing down to zero at the junction between the long side and the other short side 18. The left hand half of FIG. 2 shows the bead 38 in the form in which it extends over the whole periphery of the end portion 14. The bead 38 can be formed by conventional press tooling.

In the manufacture of a heat exchanger of the kind shown in FIG. 1, all of the tubes in the bundle are subjected to a press forming operation in order to form the beads 38 on their respective end portions 14. The end portions 14 of the tubes are then simultaneously introduced into the holes 20 in the header plate 22, the latter having been previously furnished with its sealing gasket 32. In order to ensure proper sealing, each of the end portions 14 then undergoes a radial expansion operation (as indicated by the arrows F in FIG. 1), so as to compress the tubular portion 36 of the gasket into the annular space lying between the internal surface 30 and the tube end portion 14. This radial expansion may be carried out, for each tube, by means of a punch (not shown), which is introduced axially into the end portion 14 of the tube. This causes a slight expansion of the oblong cross section over a length L which extends from the free terminal edge 40 of the tube down to a peripheral shoulder 50 lying beyond the bead 38.

Figure 3:
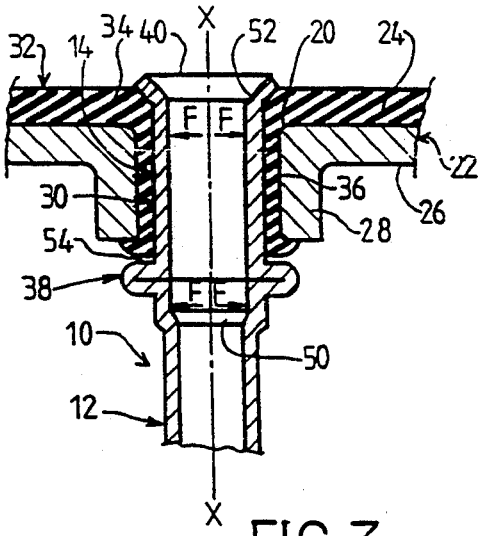
FIG. 3 is a view similar to FIG. 1, but shows a second embodiment.

Referring now to FIG. 3 showing a second embodiment, the free terminal edge 40 of each tube is, in this arrangement, subjected after assembly of the heat exchanger to an operation which deforms it so as to form a flared mouth 52. In this example this flared mouth is fustoconical. It may extend over the whole periphery of the tube, or may be localised, for example on the long sides 16 of the tubes only. In this case the sealing of the gasket 32 is ensured solely by radial compression, due to the expansion undergone by the tube end portion 14 as indicated by the arrows F. The flared mouth 52 serves mainly to prevent any separation of the tubes in the bundle from the header plate 22.

It will also be noted that in the embodiment shown in FIG. 3, a free annular gap 54 exists between the tubular portion 36 of the gasket and the bead 38. Because of this, no axial compression is exerted on the gasket.

Figure 4:
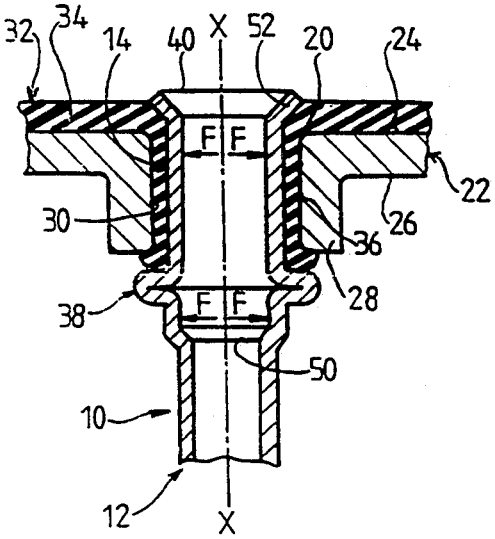
FIG. 4 is a view similar to FIG. 1, but shows a third embodiment.

Referring now to FIG. 4 showing a third embodiment, the configuration of the tube end portion 14 is here similar to that in FIG. 3. However, formation of the flared mouth 52 provides a degree of axial compression of the tubular portion 36 of the gasket. This portion 36 is thus not only compressed radially by radial expansion of the tube end portion 14 as indicated by the arrows F, but is also compressed axially by formation of the flared mouth 52. In this connection, the tubular portion 36 of the gasket is compressed axially between the bead 38 on one side and the flared mouth 52 on the other.

Figure 5:
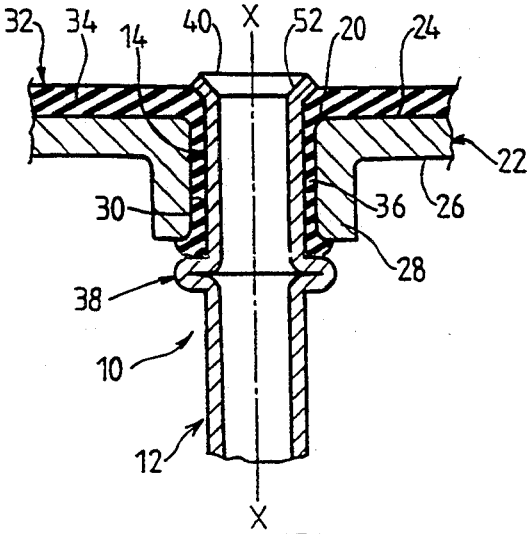
FIG. 5 is a view similar to FIG. 1, but shows a fourth embodiment.

In the fourth embodiment of the invention shown in FIG. 5, a flared mouth 52 is again provided on each tube. The associated tubular portion 36 of the gasket is again compressed axially between the bead 38 and the flared mouth 52. However, in this case the tube end portion 14 is not expanded radially as in the embodiments described above. Radial compression of the gasket is effected beforehand by introduction of a punch into it, and the tube end portion 14 is then inserted into the tubular portion 36 of the gasket.

The invention is not limited to the embodiments described above. In particular, the oblong shape of the tube end portion may be flattened to a greater or lesser extent; it may for example be oval, elliptical, or in the form of a flat tube having two large parallel sides.

The invention is especially applicable to cooling radiators for motor vehicle engines, in which the tubes in the bundle are provided with fins and connected between two headers.

What is claimed is:

1. A heat exchanger comprising: a header plate defining a multiplicity of oblong through holes therein, each defining an internal surface of the hole; a set of tubes of oblong cross section, each having an end portion engaged in a corresponding one of the holes in the header plate; and a sealing gasket having a multiplicity of tubular gasket portions, each interposed between the internal surface of a corresponding said hole and the corresponding tube end portion so as to be compressed, wherein each tube end portion has a free terminal edge and a wall reinforced by a bead spaced away from the terminal edge, wherein the bead extends over part of the periphery of the corresponding end portion.

2. A heat exchanger according to claim 1, wherein the terminal edge of each tube end portion is formed in extension of the oblong cross section of the end portion, the latter being deformed by radial expansion of its wall so as to compress the said tubular gasket portion radially.

3. A heat exchanger according to claim 2, wherein the header plate defines a collar portion around each of its said holes, each said collar portion defining a said internal surface of the respective hole and depending from the header plate, the end portion of each tube being expanded radially over a length which is at least equal to the length of the corresponding said collar portion.

4. A heat exchanger according to claim 1, wherein the said terminal edge of each tube end portion is at least partially deformed so as to define a flared mouth of the tube.

5. A heat exchanger according to claim 4, wherein each said tubular gasket portion is compressed radially between the corresponding tube end portion and the said internal surface of the corresponding hole.

6. A heat exchanger according to claim 4, wherein each said tubular gasket portion is compressed axially between the bead and the flared mouth of the associated tube.

7. A heat exchanger according to claim 4, wherein each said tubular gasket portion is compressed radially between the end portion of the corresponding tube and the internal surface of the corresponding said hole, and is compressed axially between the bead and the flared mouth of the same tube.

8. A heat exchanger according to claim 4, wherein the header plate defines a collar portion around each of its said holes, each said collar portion defining a said internal surface of the respective hole and depending from the header plate, each said tubular gasket portion being interposed between the internal surface of the corresponding hole and the associated tube end portion, an annular space around the end portion of each tube being defined axially by the bead and flared mouth of that tube, and radially by the end portion of the tube and the internal surface of the corresponding said hole, with the said tubular gasket portion associated therewith being compressed in the said space.

9. A heat exchanger according to claim 1, wherein each said bead extends over the whole periphery of the corresponding tube end portion.

10. A heat exchanger according to claim 1, wherein each said bead extends over part of the periphery of the corresponding end portion.

* * * * *